US009536413B2

(12) United States Patent
Shao et al.

(10) Patent No.: US 9,536,413 B2
(45) Date of Patent: Jan. 3, 2017

(54) VERIFYING AND MONITORING STOVE OPERATION

(71) Applicant: Persia, Inc., San Jose, CA (US)

(72) Inventors: Yucheng Shao, San Jose, CA (US); Chien-Hsun Wang, Pleasanton, CA (US)

(73) Assignee: Persia, Inc., San Jose, CA (US)

( * ) Notice: Subject to any disclaimer, the term of this patent is extended or adjusted under 35 U.S.C. 154(b) by 28 days.

(21) Appl. No.: 14/475,583

(22) Filed: Sep. 3, 2014

(65) Prior Publication Data

US 2016/0063837 A1 Mar. 3, 2016

(51) Int. Cl.

| | |
|---|---|
| ***G08B 21/00*** | (2006.01) |
| ***G08B 21/04*** | (2006.01) |
| ***F24C 7/08*** | (2006.01) |
| ***G08B 21/24*** | (2006.01) |

(52) U.S. Cl.

CPC ..... *G08B 21/0484* (2013.01); *F24C 7/081* (2013.01); *G08B 21/24* (2013.01)

(58) Field of Classification Search

CPC ..... F24C 7/08; F24C 7/081; G08B 21/0484; G08B 21/24; G08B 21/22; Y10T 74/2084; Y10T 16/487; G05G 1/10

USPC ..... 340/540, 517, 500, 686.1, 506, 584; 200/308; 219/490, 448.12, 445.1, 446.1; 307/326; 126/42

See application file for complete search history.

(56) References Cited

U.S. PATENT DOCUMENTS

| | | | | |
|---|---|---|---|---|
| 5,717,188 | A * | 2/1998 | Vaillancourt | H05B 1/0263 219/446.1 |
| 6,294,994 | B1 * | 9/2001 | Hoellerich | F24C 7/08 219/490 |
| 7,342,492 | B2 * | 3/2008 | Ludenia | D06F 39/005 200/308 |
| 7,816,818 | B2 * | 10/2010 | Sellecchia | F24C 7/08 126/42 |
| 8,362,906 | B1 * | 1/2013 | Glassman | G05B 19/02 219/714 |
| 2008/0055241 | A1 * | 3/2008 | Goldenberg | G06F 3/016 345/156 |

* cited by examiner

*Primary Examiner* — Anh V La
(74) *Attorney, Agent, or Firm* — Patent Law Group LLP; David C. Hsia

(57) ABSTRACT

A method for an apparatus to monitor an appliance includes receiving information about a translation of a control knob of the appliance along an axis and a rotation of the control knob around the axis, determining if a first event has occurred based on the information, and, when the first event has occurred, starting a timer and determining if a second event has occurred based on the information before the timer reaches a time interval. The method further includes, when the second event does not occur before the timer reaches the time interval, triggering an alert.

20 Claims, 5 Drawing Sheets

| Handle Position Index | Angular Values | Stove Operation Status |
|---|---|---|
| Off | B0 | Off |
| Ignite | B1 | Ignite |
| High | B2 | High |
| Medium | B3 | Medium |
| Low | B4 | Low |

VERIFYING AND MONITORING STOVE OPERATION

BACKGROUND

A kitchen fire may be caused when a homeowner forgets about food left cooking on a stove. This problem may be of special concern for elderly homeowners.

BRIEF DESCRIPTION OF THE DRAWINGS

In the drawings.

Use of the same reference numbers in different figures indicates similar or identical elements.

DETAILED DESCRIPTION

As used herein, the term "includes" means includes but not limited to, the term "including" means including but not limited to. The terms "a" and "an" are intended to denote at least one of a particular element. The term "based on" means based at least in part on. The term "or" is used to refer to a nonexclusive such that "A or B" includes "A but not B," "B but not A," and "A and B" unless otherwise indicated.

In examples of the present disclosure, a cooking appliance monitor is provided on a control knob of a cooking appliance. The cooking appliance monitor or another device determines if a burner has been turned on based on information about translation and rotation of the control knob detected by the cooking appliance monitor. When the burner has been turned on, the cooking appliance monitor or the other device starts a timer and determines if the burner has been turned off before the timer reaches a time interval. When the burner is not turned off before the timer reaches the time interval, the cooking appliance monitor or the other device triggers an alert to warn a user or an emergency responder that the burner has been left on for some time.

Figure 1:
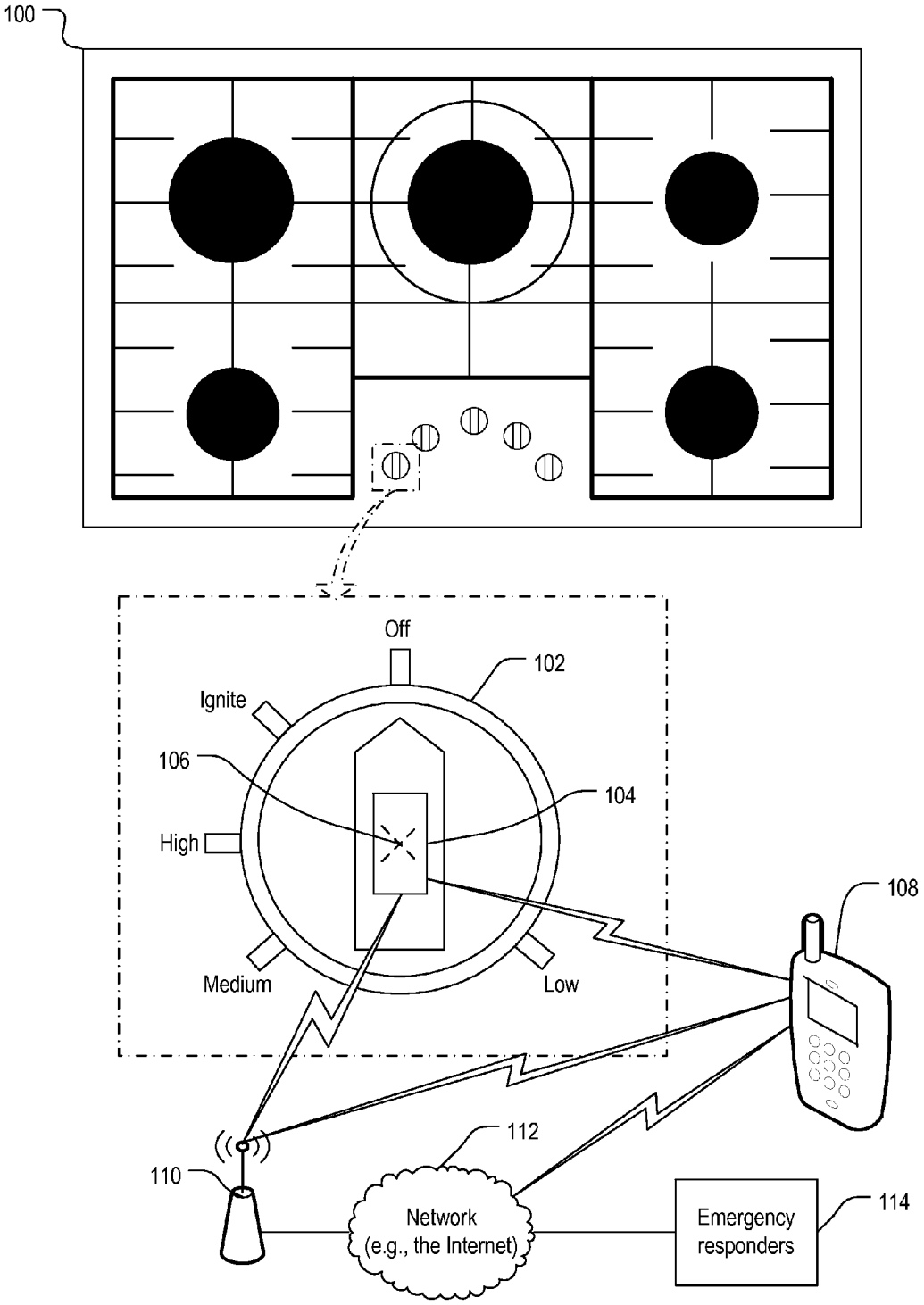
FIG. 1 shows a cooking appliance with a control knob and a cooking appliance monitor in examples of the present disclosure.

FIG. 1 shows a cooking appliance 100 with a control knob 102 and a cooking appliance monitor 104 in examples of the present disclosure. Cooking appliance 100 may be a range, a rangetop, a cooktop, an oven, or another cooking appliance. Cooking appliance 100 has a push-to-turn safety feature for igniting a burner. To ignite the burner, control knob 102 is to be pushed in (or down depending on the control knob orientation) and then turned to a desired heat setting. Heat settings may be marked on cooking appliance 100 or control knob 102.

Cooking appliance monitor 104 is a distinct device separate from control knob 102. Alternatively cooking appliance monitor 104 may be integrated with control knob 102. Cooking appliance monitor 104 monitors a translation of control knob 102 along an axis 106 (shown in phantom) and a rotation of control knob 102 around axis 106. One or more conditions can be detected based on the translation and the rotation of control knob 102, such as a burner being left on greater than a time interval or a burner being improperly ignited. The intelligence to detect the one or more conditions may be located in cooking appliance monitor 104, a user's computing device 108 (e.g., a smart phone), or a controller device 110 paired with cooking appliance monitor 104 as a set. Controller device 110 is coupled to a network 112, such as the Internet.

In some examples of the present disclosure, the intelligence to detect the one or more conditions is located in cooking appliance monitor 104. When cooking appliance monitor 104 detects one or more conditions based on translation and rotation of control knob 102, cooking appliance monitor 104 wirelessly transmits a message (e.g., through Bluetooth) to computing device 108. The message causes computing device 108 to generate an alert, such as a popup window with an audible alarm, to warn the user of the one or more conditions. The user may be a homeowner, a relative of the homeowner, or a caregiver of the homeowner. As cooking appliance monitor 104 may be equipped with a short range wireless interface (e.g., Bluetooth), cooking appliance monitor 104 may wirelessly transmit the message (e.g., through Bluetooth) to controller device 110 that is located close by and equipped with a longer range power wireless interface (e.g., Wi-Fi). The message causes controller device 110 to transmit the same message or another message directly (e.g., through Wi-Fi) or indirectly (e.g., over network 112) to the user's computing device 108. Controller device 100 may also transmit the same message or another message to an emergency responder's computing device 114 to warn the proper authorities of the one or more conditions.

In examples of the present disclosure where the intelligence to detect the one or more conditions is located in the user's computing device 108, cooking appliance monitor 104 wirelessly transmits information about translation and rotation of control knob 102 to computing device 108. Cooking appliance monitor 104 may also wirelessly transmit the information (e.g., through Bluetooth) to controller device 110, which forwards the information directly (e.g., through Wi-Fi) or over network 112 to computing device 108. When computing device 108 detects one or more condition based on the information, computing device 108 triggers an alert to the user.

In examples of the present disclosure where the intelligence to detect the one or more conditions is located in controller device 110, cooking appliance monitor 104 wirelessly transmits information about translation and rotation of control knob 102 (e.g., through Bluetooth) to controller device 110. When controller device 110 detects one or more conditions based on the information, controller device 110 transmits a message directly (e.g., through Wi-Fi) or indirectly (e.g., over communication network 112) to the user's computing device 108 or the emergency responder's computing device 114 to trigger an alert for the user or the emergency responder. The user's computing device 108 or the emergency responder's computing device 114 then generates the alert to warn the user or the emergency responder of the one or more conditions.

Figure 2:
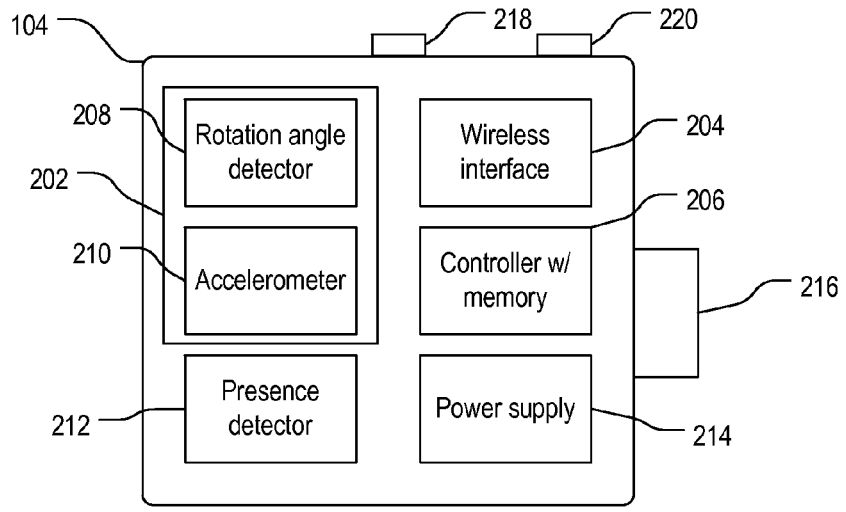
FIG. 2 is a block diagram of the cooking appliance monitor of FIG. 1 in examples of the present disclosure.

FIG. 2 is a block diagram of cooking appliance monitor 104 in examples of the present disclosure. Cooking appliance monitor 104 includes one or more control knob position sensors 202 to detect a translation of control knob 102 (FIG. 1) along axis 106 (FIG. 1) and a rotational of control knob 102 about axis 106. Cooking appliance monitor 104 further includes a wireless interface 204 and a controller 206 coupled to position sensors 202 and wireless interface 204. Wireless interface 204 may be a Bluetooth, Wi-Fi, ZigBee, or an industrial, scientific, and medical (ISM) band interface. Controller 206 uses position sensors 202 to monitor the translation and the rotation of control knob 102. When cooking appliance monitor 104 is the device that detects the one or more conditions, controller 206 uses wireless interface 204 to transmit the message that triggers an alert to computing device 108 (FIG. 1) or controller device 110 (FIG. 1). When cooking appliance monitor 104 is not the device that detects the one or more conditions, controller 206 uses wireless interface 204 to transmit information about the translation and the rotation of control knob 102 to computing device 108 or controller device 110.

Figure 3:
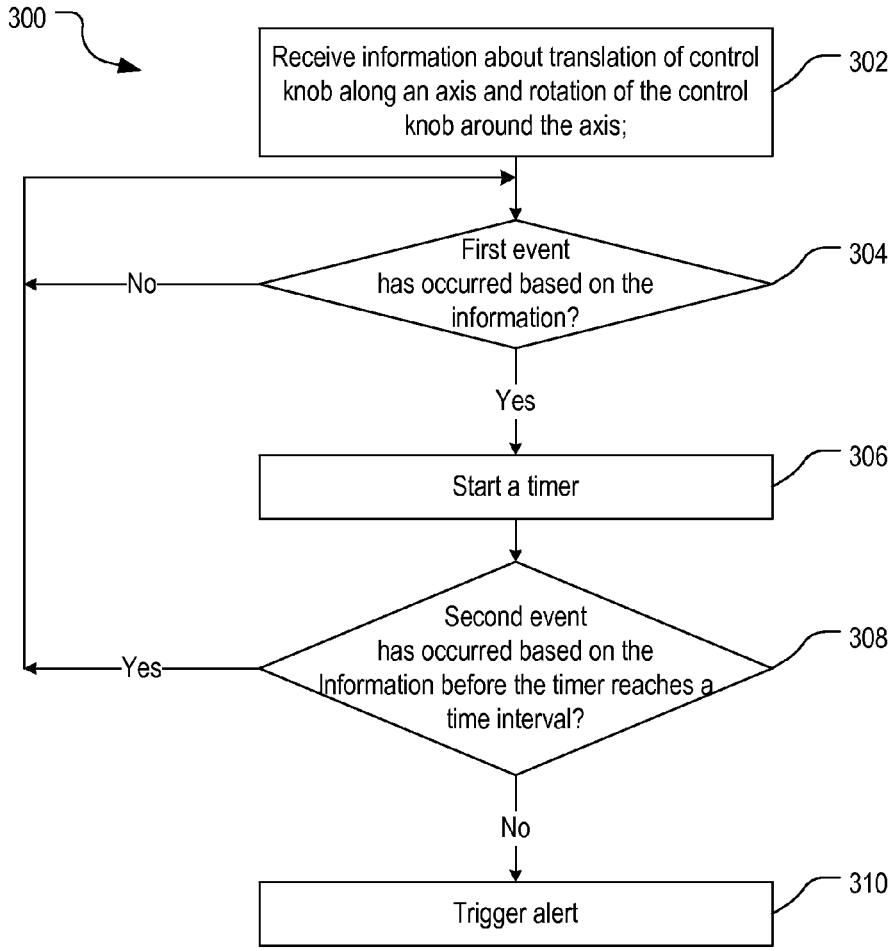
FIG. 3 is a flowchart of a method for a device to detect certain conditions from translation and rotation of the control knob of FIG. 1 in examples of the present disclosure.

FIG. 3 is a flowchart of a method 300 for a device with the intelligence to detect certain conditions based on information about translation and rotation of control knob 102 (FIG. 1) provided by cooking appliance monitor 104 (FIG. 1) in examples of the present disclosure. As discussed before, this device may be located in cooking appliance monitor 104, computing device 108, or controller device 110. Although the blocks in method 300, and any method described hereafter, are illustrated in a sequential order, these blocks may also be performed in parallel or in a different order than those described herein. Also, the various blocks may be combined into fewer blocks, divided into additional blocks, or eliminated based upon the desired implementation. Method 300 may begin in block 302.

In block 302, the device receives information about the translation of control knob 102 (FIG. 2) along axis 106 (FIG. 1) and the rotation of control knob 102 about axis 106 provided by cooking appliance monitor 104. Block 302 may be followed by block 304.

In block 304, the device determines if a first event has occurred based on the translation and the rotation of control knob 102. For example, the first event is a burner being turned on. If the first event has occurred, block 304 may be followed by block 306. Otherwise block 304 may loop back to itself to wait for the first event to occur.

In block 306, the device starts a timer that measures a time interval. The time interval may be set by the user. Block 306 may be followed by block 308.

In block 308, the device determines if a second event has occurred based on the translation and the rotation of control knob 102 before the timer reaches the time interval. For example, the second event is the burner being turned off. If the second event has occurred before the timer reaches the time interval, block 308 may loop back to block 304 to wait for the first event to occur again. Otherwise block 308 may be followed by block 310.

In block 310, the device triggers an alert. As discussed before, the device can trigger the alert locally by generating the alert, or the device can trigger the alert remotely by transmitting a message directly or indirectly to computing device 108 or emergency responder device 114. The alert warns the user to check on cooking appliance 100 to make sure a burner has not been left on unattended.

Referring back to FIG. 2, position sensors 202 may include a micro-electro-mechanical systems (MEMS) accelerometer 208 and a rotation angle detector 210 both coupled to controller 206. Controller 206 uses data from accelerometer 208 to detect control knob 102 being pushed in or down. Controller 206 uses data from rotation angle detector 210 to detect the heat setting of cooking appliance 100 (FIG. 1). Rotation angle detector 210 may be a MEMS gyroscope or eCompass. Alternatively a single three-axis MEMS accelerometer is used to measure translation and rotation.

In one example of the present disclosure, cooking appliance monitor 104 may include a presence detector 212 coupled to controller 206. Controller 206 uses data from presence detector 212 to detect human presence near cooking appliance 100. Presence detector 212 may be a motion detector. In another example, presence detector 212 may be a separate device from cooking appliance monitor 104 that wireless communicates its data to controller 206 via wireless interface 204. In yet another example, wireless interface 204 may be used as a presence detector. Wireless interface 204 measures the wireless signal strength of the user's computing device 108. Controller 206 assumes a human is present when the wireless signal strength is greater than or equal to a threshold level, and assumes a human is absent when the wireless signal strength is less than the threshold level.

Cooking appliance monitor 104 includes a power supply 214 coupled to power the other components. Cooking appliance monitor 104 includes an adhesive, a rubber band, a magnet, or a fastener 216 that attach cooking appliance monitor 104 to control knob 102. Alternatively cooking appliance monitor 104 may be integrated with control knob 102 as described earlier.

Figure 4:
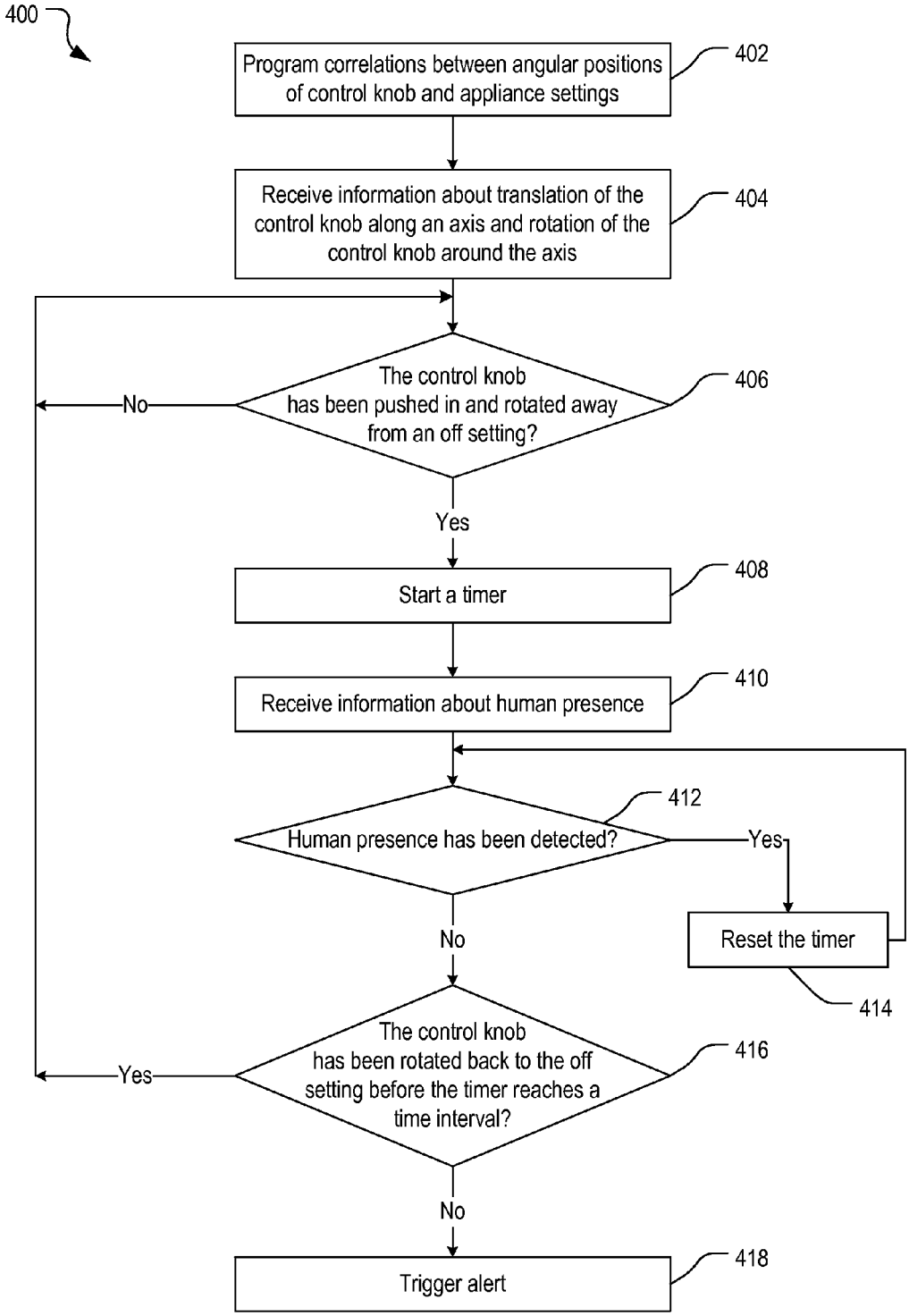
FIG. 4 is a flowchart of another for a device to detect certain conditions from translation and rotation of the control knob of FIG. 1 in examples of the present disclosure.

FIG. 4 is a flowchart of a method 400 for a device with the intelligence to detect certain conditions based on information about translation and rotation of control knob 102 (FIG. 1) provided by cooking appliance monitor 104 (FIG. 1) in examples of the present disclosure. As discussed before, this device may be located in cooking appliance monitor 104, computing device 108, or controller device 110. Method 400 may be a variation of method 300 (FIG. 3). Method 400 may begin in block 402.

In block 402, the device is programmed with correlations between angular positions of control knob 102 (FIG. 1) and heat settings of cooking appliance 100.

Figures 5, 6:
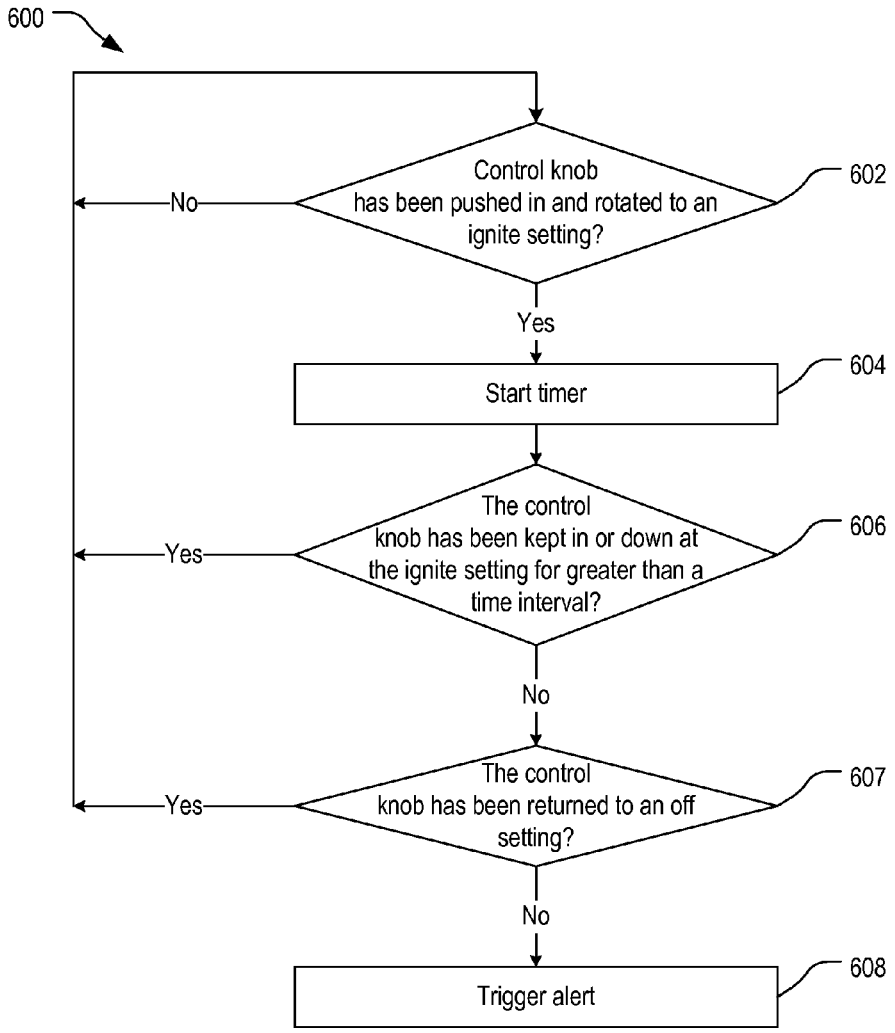
FIG. 5 shows a table of the correlations between rotation angles and settings of the cooking appliance of FIG. 1 captured by a device in examples of the present disclosure.
FIG. 6 is a flowchart of yet another method for a device to detect certain conditions from translation and rotation of the control knob of FIG. 1 in examples of the present disclosure.

In the examples where the device is cooking appliance monitor 104, cooking appliance monitor 104 has a setup button 218 (FIG. 2) and a light-emitting diode (LED) 220 (FIG. 2). When setup button 218 is depressed for a period of time, cooking appliance monitor 104 enters into a setup mode. In the setup mode, controller 206 (FIG. 2) uses LED 220 to signal a user to cycle control knob 102 through the heat settings, including the ignite setting, at specific times so controller 206 can record the correlations between the heat settings and angular positions of control knob 102, which is determined from rotation angle detector 210 (FIG. 2). FIG. 5 shows a table of the correlations captured by controller 206 in memory in examples of the present disclosure. In the setup mode, controller 206 may also use LED 220 to signal a user to push in or down control knob 102 so controller 206 can record the correlation between the push action and a linear translation of control knob 102, which is determined from accelerometer 208 (FIG. 2).

In the examples where the device is computing device 108, an application on computing device 108 is used in this initial setup. In communication with controller 206, the application signals the user to cycle control knob 102 through the heat settings, including the ignite setting, and the push in or down action, and receives rotation angles and a linear translation of control knob 102 from cooking appliance monitor 104. The application can provide visual or voice step-by-step instructions to the user.

In the examples where the device is controller device 110, controller device 110 operates similarly in a setup mode as described before for cooking appliance monitor 104 except controller device 110 is receiving rotation angles and a linear translation of control knob 102 from cooking appliance monitor 104.

Referring back to FIG. 4, block 402 may be followed by block 404.

In block 404, the device receives information about the translation and the rotation of control knob 102 from cooking appliance monitor 104. Block 404 may be followed by block 406. Block 404 corresponds to block 302 (FIG. 3) of method 300.

In block 406, the device determines if control knob 102 has been pushed in or down and rotated away from the off setting of cooking appliance 100. In one example, the device determines if control knob 102 has been pushed in or down, rotated to the ignite setting of cooking appliance 100, and held pushed in or down for more than a predetermined time period to ignite a burner. If so, block 406 may be followed by block 408. Otherwise block 406 may loop back to itself to wait for control knob 102 to be pushed in or down and rotated away from the off setting of cooking appliance 100. Block 406 corresponds to block 304 (FIG. 3) of method 300.

In block 408, the device starts a timer that measures a time interval. The time interval may be set by the user. Block 408 may be followed by block 410. Block 408 corresponds to block 306 (FIG. 3) in method 300.

In block 410, the device receives information about human presence from cooking appliance monitor 104. Block 410 may be followed by block 412.

In block 412, the device determines if human presence has been detected. If so, block 412 may be followed by block 414. Otherwise block 412 may be followed by block 416.

In block 414, the device resets the timer. Alternatively the device sets the timer with a shorter interval that is adjusted based on the total time the cooking appliance 100 has been on. Block 414 may loop back to block 410 until the device no longer detects human presences.

In block 416, the device determines if control knob 102 has been rotated back to the off setting before the timer reaches the time interval. If so, block 416 may loop back to block 406 to wait for control knob 102 to be pushed in or down and rotated away from the off setting again. Otherwise block 416 may be followed by block 418. Block 416 corresponds to block 308 (FIG. 3) in method 300.

In block 418, the device triggers an alert. As discussed before, the device can trigger the alert locally by generating the alert, or the device can trigger the alert remotely by transmitting a message directly or indirectly to computing device 108 or emergency responder device 114. The alert warns the user to check on cooking appliance 100 to make sure a burner has not been left on unattended. Block 418 corresponds to block 310 (FIG. 3) of method 300.

FIG. 6 is a flowchart of a method 600 for a device with the intelligence to detect certain conditions based on information about translation and rotation of control knob 102 (FIG. 1) provided by cooking appliance monitor 104 (FIG. 1) in examples of the present disclosure. This device may be the same or different device from the device with the intelligence to detect if a burner has been left on greater than a time interval or if a burner has been left on unattended greater than a time interval. The device may be located in cooking appliance monitor 104, computing device 108, or controller device 110. Method 600 may be performed in combination or in parallel with one or more of methods 300 and 400 (described later). Method 600 may begin in block 602.

In block 602, the device determines control knob 102 (FIG. 1) has been pushed in or down and rotated to the ignite setting of cooking appliance 100. If so, block 602 may be followed by block 604. Otherwise block 602 may loop back to itself to wait for control knob 102 to be pushed in or down and rotated away to the ignite setting of cooking appliance 100.

In block 604, the device starts a timer. Block 604 may be followed by block 606.

In block 606, the device determines if control knob 102 has been pushed in or down at the ignite setting greater than a time interval, such as the time necessary to properly ignite the burner. If so, block 606 may loop back to block 602. Otherwise block 606 may be followed by block 607. The time interval may be set by the user.

In block 607, the device determines if control knob 102 has been returned to the off setting. If so, block 607 may loop back to block 602. Otherwise block 607 may be followed by block 608.

In block 608, the device triggers an alert. As discussed before, the device can trigger the alert locally by generating the alert, or the device can trigger the alert remotely by transmitting a message directly or indirectly to computing device 108 or emergency responder device 114. The alert warns the user to check on cooking appliance 100 as a burner may be leaking gas because it was not properly ignited.

Figure 7:
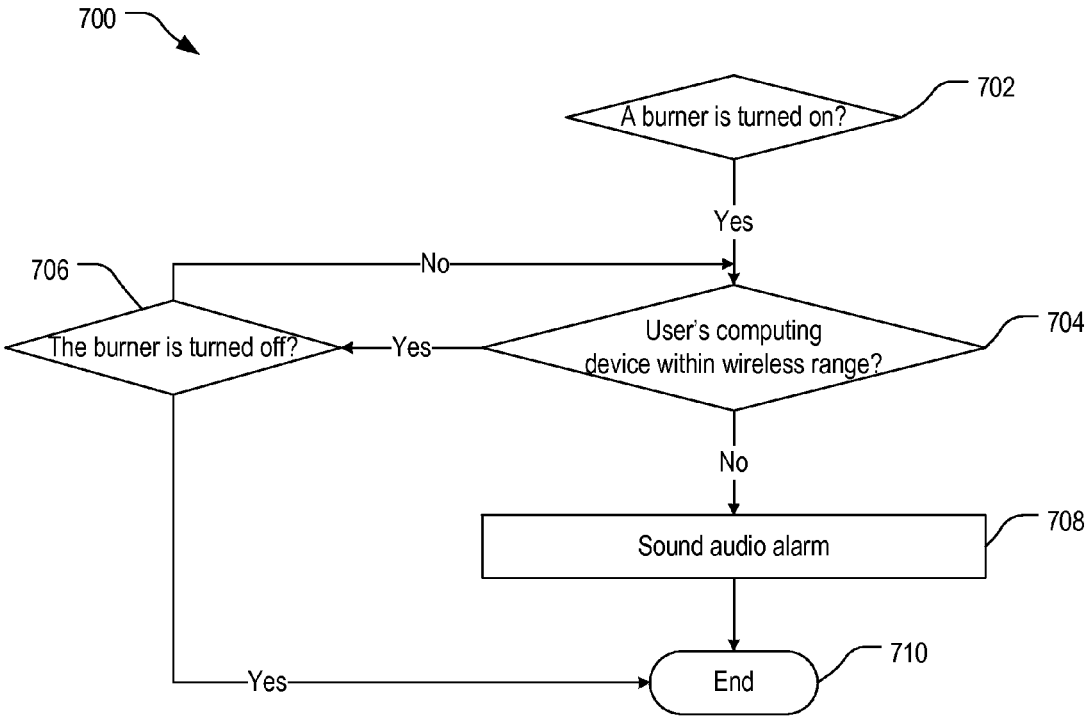
FIG. 7 is a flowchart of a method for a device to warn a user when the user wanders too far to receive any communication from the cooking appliance monitor of FIG. 1 in examples of the present disclosure.

FIG. 7 is a flowchart of a method 700 for a device with the intelligence to warn a user when the user wanders too far to receive a message to trigger an alert or information about the translation and the rotation of control knob 102 in examples of the present disclosure. This device may be the same or different device from the device with the intelligence to detect if a burner has been left on greater than a time interval, if a burner has been left on unattended greater than a time interval, or if a burner has not been properly ignited. The device may be located in cooking appliance monitor 104, computing device 108, or controller device 110. Method 700 may be performed in combination or in parallel with one or more of methods 300, 400, and 600. Method 700 may begin in block 702.

In block 702, the device determines if a burner is turned on. For example, the device determines if control knob 102 (FIG. 1) has been pushed in or down, rotated to the ignite setting of cooking appliance 100, and held pushed in or down for more than a predetermined time period to ignite a burner. Alternatively the device may be informed by another device that the burner has been turned on. If the burner has been turned on, block 702 may be followed by block 704. Otherwise block 702 loops back to itself to wait for a burner to be ignited.

In block 704, the device determines if the user's computing device 108 (FIG. 1) is within wireless range. If so, block 704 may be followed by block 706. Otherwise block 704 may be followed by block 708.

In block 706, the device determines if the burner has been turned off. For example, the device determines if control knob 102 has been returned to the off setting. Alternatively the device may be informed by another device that the burner has been turned off. If the burner has been turned off, block 706 may be followed by block 710, which ends method 700. Otherwise block 706 may loop back to block 704.

In block 708, the device causes a speaker to sound an audible alarm. This audible alarm is intended to bring the user back to cooking appliance 100 when the user wanders outside of the wireless range of the device. Block 708 may be followed by block 710, which ends method 700.

Various other adaptations and combinations of features of the examples disclosed are within the scope of the present disclosure.

What is claimed is:

1. A method for an apparatus to monitor an appliance, comprising:
- receiving information about a translation of a control knob of the appliance along an axis and a rotation of the control knob around the axis from one or more position sensors;
- determining by a controller if a first event has occurred based on the information;
- when the first event has occurred:
  - starting a timer; and
  - determining if a second event has occurred based on the information before the timer reaches a time interval; and
- when the second event does not occur before the timer reaches the time interval, triggering an alert.

2. The method of claim 1, wherein said triggering the alert comprises directly or indirectly transmitting a message to a computing device, wherein the computing device generates the alert in response to the message.

3. The method of claim 2, further comprising emitting an audible alarm when the computing device is out of wireless range to directly receive the message.

4. The method of claim 2, further comprising:
- receiving information about human presence; and
- when human presences is detected, resetting the timer or set the timer with a shorter time interval.

5. The method of claim 4, wherein said receiving information about human presence comprises detecting motion or detecting a wireless signal strength of the computing device is greater than a threshold level.

6. The method of claim 1, wherein the first event comprises the control knob being pushed in or down and rotated away from an off setting of the appliance.

7. The method of claim 6, wherein the second event comprises the control knob being rotated back to the off setting of the appliance.

8. The method of claim 7, further comprising programming the apparatus by recording a correlation between an angular position of the control knob and the off setting of the appliance.

9. The method of claim 1, further comprising:
- determining if the control knob has been pushed in or down and rotated to an ignite setting of the appliance;
- when the control knob has been pushed in or down and rotated to the ignite setting, starting another timer;
- determining if the control knob is kept pushed in or down at the ignite setting for another time interval; and
- when the control knob has not been kept pushed in or down at the ignite setting for the other time interval, trigger another alert.

10. The method of claim 1, wherein the apparatus is attached to the control knob or integrated with the control knob.

11. An apparatus to monitor an appliance, comprising:
- one or more position sensors to detect a translation of a control knob of the appliance along an axis and a rotation of the control knob about the axis;
- a wireless interface; and
- a controller coupled to the one or more sensors and the wireless interface, wherein the controller is to:
  - monitor the translation and the rotation of the control knob via the one or more position sensors;
  - determine if a first event has occurred based on said monitoring the translation and the rotation of the control knob;
  - when the first event has occurred:
    - start a timer; and
    - determine if a second event has occurred based on said monitoring the translation and the rotation of the control knob before the timer reaches a time interval; and
  - when the second event does not occur before the timer reaches the time interval, transmit a message via the wireless interface.

12. The apparatus of claim 11, wherein the one or more position sensors includes:
- an accelerometer to measure the translation of the control knob; and
- a rotation angle detector to measure the rotation of the control knob.

13. The apparatus of claim 11, wherein said transmitting the message comprises transmitting the message directly or indirectly to a computing device.

14. The apparatus of claim 13, wherein the controller is to cause an audible alarm when the computing device is out of wireless range to directly transmit the message to the computing device.

15. The apparatus of claim 11, further comprising a motion detector, the controller being coupled to the motion detector, wherein the controller is to:
- monitor human presence via the motion detector; and
- when human presence is detected, reset the timer or set the timer with a shorter time interval.

16. The apparatus of claim 13, wherein the controller is to:
- monitor human presence via the wireless interface where a wireless signal strength of the computing device indicates human presence; and
- when the wireless signal strength is greater than a threshold level, reset the timer or set the timer with a shorter time interval.

17. The apparatus of claim 11, wherein the first event comprises the control knob being pushed in or down and rotated away from an off setting of the appliance.

18. The apparatus of claim 17, wherein the second event comprises the control knob being rotated back to the off setting of the appliance.

19. The apparatus of claim 11, wherein the controller is to:
- determine if the control knob has been pushed in or down and rotated to an ignite setting of the appliance;
- when the control knob has been pushed in or down and rotated to the ignite setting, start another timer;
- determine if the control knob is kept pushed in or down at the ignite setting for another time interval; and
- when the control knob has not been kept pushed in or down at the ignite setting for the other time interval, transmit another message.

20. The apparatus of claim 11, wherein the apparatus is attached to the control knob or integrated with the control knob.

* * * * *